US007181154B2

(12) United States Patent
Yamada

(10) Patent No.: US 7,181,154 B2
(45) Date of Patent: Feb. 20, 2007

(54) LASER PRINTER WITH TONER CARTRIDGE

(75) Inventor: Masahiro Yamada, Daito (JP)

(73) Assignee: Funai Electric Co., Ltd., Osaka (JP)

( * ) Notice: Subject to any disclaimer, the term of this patent is extended or adjusted under 35 U.S.C. 154(b) by 0 days.

(21) Appl. No.: 11/152,610

(22) Filed: Jun. 14, 2005

(65) Prior Publication Data

US 2005/0281583 A1 Dec. 22, 2005

(30) Foreign Application Priority Data

Jun. 17, 2004 (JP) ..... 2004-179443

(51) Int. Cl.
*G03G 15/04* (2006.01)

(52) U.S. Cl. ..... 399/119; 399/120

(58) Field of Classification Search ..... 399/119
See application file for complete search history.

(56) References Cited

U.S. PATENT DOCUMENTS 5,995,782 A * 11/1999 Isobe et al. ..... 399/119
6,035,159 A * 3/2000 Azuma et al. ..... 399/111
6,535,705 B2 * 3/2003 Asakura et al. ..... 399/119
2005/0214023 A1 * 9/2005 Foster et al. ..... 399/110

FOREIGN PATENT DOCUMENTS

JP 2003-345130 12/2003

OTHER PUBLICATIONS

Patent Abstracts of Japan, Publication No.: 2003-345130, Publication Date: Dec. 3, 2003, 1 page.

* cited by examiner

*Primary Examiner*—David M. Gray
*Assistant Examiner*—Bryan Ready
(74) *Attorney, Agent, or Firm*—Osha Liang LLP

(57) ABSTRACT

A laser printer includes a coupling including an insert for transmitting driving force to a toner cartridge, a spring biasing the coupling, and a coupling receding arm positionally determining the coupling in a direction toward the toner cartridge. The coupling receding arm is formed of a single member and includes an arm portion in the form of a rod, an engagement rotated around the arm portion's longitudinal axis to move the coupling, and a lock lever connected to the arm portion and rotated around the arm portion's longitudinal axis to lock and unlock the toner cartridge.

5 Claims, 8 Drawing Sheets

LASER PRINTER WITH TONER CARTRIDGE

BACKGROUND OF THE INVENTION

1. Field of the Invention

The present invention relates generally to laser printers and particularly to their arrangements attaching a toner cartridge.

2. Description of the Background Art

A laser printer arranges toner on a surface of a photoreceptor drum charged by laser light and sandwiches a sheet between the photoreceptor drum and a transfer roller to place the toner on a surface of the sheet or the like in a shape to be transferred. The toner placed on the surface of the sheet or the like is fixed on the sheet or the like by a fixture roller and thus discharged.

Generally toner is accommodated in an exchangeable toner cartridge. When the toner runs out, the toner cartridge is exchanged to resupply toner. The toner cartridge is formed to be detachably attached to the laser printer.

FIG. 7 is a diagram for illustrating a toner cartridge arranged internal to a laser printer. FIG. 7 is a perspective view of the laser printer as seen in a plane. A toner cartridge 1 is arranged internal to a casing 45. In this example, toner cartridge 1 is formed substantially in a rectangle as seen in a plane. Toner cartridge 1 accommodates an agitator plate 39 agitating the internal toner and a developer roll 38 operated to transfer the toner on a photoreceptor drum.

Agitator plate 39 is formed in a plate, and formed substantially in a rectangle as seen in a plane. Agitator plate 39 can pivot around an axis at the plate's end corresponding to one side of the rectangle as seen in a plane. As agitator plate 39 pivots, the toner in toner cartridge 1 is agitated. Furthermore, developer roll 38 is formed in a column and rotates around the column's center axis.

As described above, toner cartridge 1 is internally provided with agitator plate 39 and other movable member. These members are actuated by force transmitted outside toner cartridge 1 via a coupling 56. More specifically, the laser printer's main body transmits the force via coupling 56 for actuation.

In FIG. 7, toner cartridge 1 is adapted to be detachably attachable to the printer's main body in a direction 68. Coupling 56 is adapted to be movable as indicated by an arrow 60. Coupling 56 is formed to have a portion inserted into and detached from toner cartridge 1.

When toner cartridge 1 is attached to the laser printer, toner cartridge 1 receives the coupling 56 insert to engage coupling 56 and a linking portion internal to toner cartridge 1. The coupling rotates around an axis parallel to the direction of the insertion to transmit force into toner cartridge 1 for actuation. When toner cartridge 1 is removed, coupling 56 is detached from toner cartridge 1.

FIG. 8 is a diagram for illustrating coupling 56 based on conventional art and a portion of toner cartridge 1 with which coupling 56 is engaged. Coupling 56 is supported by a support frame 21 formed internal to the casing.

Coupling 56 includes a gear 50, a presser 55, and an insert 53 inserted into a coupling insertion hole 11 formed in toner cartridge 1. By inserting insert 53 into coupling insertion hole 11 the rotational movement of gear 50 can be transmitted to toner cartridge 1.

To attach toner cartridge 1, toner cartridge 1 is inserted in a direction parallel to an end surface of insert 53, as indicated by an arrow 71. Gear 50 is formed to be movable in a direction parallel to that toward the toner cartridge 1. To exchange toner cartridge 1 the coupling 56 insert 53 recedes from coupling insertion hole 11 of toner cartridge 1. Furthermore when coupling 56 has toner cartridge 1 attached thereto, insert 53 is inserted in coupling insertion hole 11.

FIGS. 9 and 10 are diagrams for illustrating an arrangement for moving the coupling's insert. FIGS. 9 and 10 are side views of coupling 56. As shown in FIG. 9, coupling 56 includes gear 50, and first and second coupling members 51 and 52. Insert 53 is formed at the first coupling member 51. Insert 53 is formed to penetrate the second coupling member 52. Insert 53 is formed in a column.

The first coupling member 51 has a side surface provided with presser 55 in the form of a plate. The second coupling member 52 has a portion having a side surface inclined. The second coupling member 52 is set in the first coupling member 51 at an inclined portion 58, as indicated by an arrow 69.

The second coupling member 52 is fixed to the support frame immovably. The first coupling member 51 is rotatable around the columnar center axis of insert 53. When toner cartridge 1 is attached to the printer, insert 53 protrudes from a surface of the second coupling member 52, as shown in FIG. 9.

Presser 55 is connected for example to a door arranged at a front surface of the cartridge of the laser printer and for example by opening the door presser 55 is pushed (or pulled).

FIG. 10 is a side view with the first coupling member 51 rotated. As the first coupling member 51 rotates, the first coupling member 51 moves along the geometry of inclined portion 58 in a direction 70. Accordingly, insert 53 protruding from the surface of the second coupling member 52 moves in direction 70 and recedes from the toner cartridge's coupling insertion hole. Thus the insert protrudes from/recedes into the surface of the second coupling member 52.

Other than the above, Japanese Patent Laying-Open No. 2003-345130 discloses an image formation apparatus including a development frame pressing a development roller to contact a photoreceptor drive, and a lock member restricted in movement as an actuation rod moves. The publication discloses that in this image formation apparatus an unlocking member can perform one return operation to disengage and unlock the photoreceptor drum and the development roller to extract a toner cartridge.

In the FIGS. 8–10 conventional art laser printer the door located at a front side of the toner cartridge is opened and closed to push (or pull) the coupling's presser and thus insert the coupling's insert into the toner cartridge's coupling insertion hole and allow the insert to recede from the hole.

The above described coupling's structure is, however, significantly complicated and thus contributes to poor productivity. Furthermore, it requires a large number of components resulting in poor productivity. The image formation apparatus disclosed in the above publication is also disadvantageous in that it has a complicated structure and furthermore requires a large number of components, which renders expensive a laser printer to be manufactured.

SUMMARY OF THE INVENTION

The present invention has been made to overcome the above disadvantages and it contemplates a laser printer having a simple configuration and formed of a reduced number of components.

To achieve the above object the present invention in one aspect provides a laser printer including: a toner cartridge removable from a laser printer through a front side; a support frame arranged at a side of the toner cartridge; and a coupling supported by the support frame, movable toward and away from the toner cartridge, and including an insert at a side thereof facing the toner cartridge. The laser printer also includes: a spring biasing to force the coupling toward the toner cartridge; and a coupling receding arm moving the coupling. The coupling receding arm is formed of a single member and includes: an arm portion provided in a form of a rod having an axis extending in forward and backward directions; an engagement provided at a rear end of the arm portion in a cuboid and connected to the arm portion at a portion of the cuboid other than a midpoint of the cuboid as seen lengthwise; and a lock lever provided at a front end of the arm portion in a flat plate in a form of a letter L, as seen in a plane, and connected at one end of the L letter to the arm portion. The coupling receding arm is adapted such that when the toner cartridge is attached the lock lever is rotated around the arm portion's longitudinal axis and thus turned downward to contact a front surface of the toner cartridge and furthermore set the engagement to have a longitudinal direction substantially parallel to the coupling's contact surface to allow the insert to be inserted into the toner cartridge. The coupling receding arm is adapted such that to remove the toner cartridge the lock lever is rotated around the arm portion's longitudinal axis and thus raised to detach from the toner cartridge and furthermore set the engagement to have its longitudinal direction substantially perpendicular to the coupling's contact surface to push the coupling to recede the insert from the toner cartridge. This arrangement can provide a laser printer having a simplified configuration and formed of a reduced number of components.

To achieve the above object the present invention in another aspect provides a laser printer including: a coupling movable in a direction parallel to that toward a toner cartridge, and including an insert for transmitting driving force to the toner cartridge; a biasing member for biasing the coupling toward the toner cartridge; and a coupling receding member for determining a position of the coupling in the direction parallel. The coupling receding member is formed of a single member and includes an arm portion in a form of a rod, an engagement connected to the arm portion and rotated around the arm portion's longitudinal axis to move the coupling in the direction parallel, and a lock lever connected to the arm portion and rotated around the arm portion's longitudinal axis to lock and unlock the toner cartridge. The coupling receding member moves the lock lever in one direction to insert the insert into the toner cartridge and cause the lock lever to contact one surface of the toner cartridge. This arrangement can provide a laser printer having a simplified configuration and formed of a reduced number of components.

In the present invention preferably the lock lever is provided at an end of the arm portion and formed to be flat to conform to a geometry of a surface securing the toner cartridge and has an end having a protrusion protruding from a main surface thereof This arrangement allows the lock lever to be formed in a simple configuration and the protrusion can be hooked to help to recede the lock lever from the toner cartridge.

In the present invention preferably the engagement is provided at an end of the arm portion, has a longitudinal direction, and has the arm portion connected thereto at a location other than a midpoint as seen in the longitudinal direction of the engagement. This can help to form the engagement.

In the present invention preferably the lock lever is formed in a letter L, as seen in a plane, having one end with the arm portion fixed thereto and the other end provided with the protrusion and the engagement is formed in a cuboid having one surface with the arm portion fixed thereto. This allows a simple configuration to be used to provide the lock lever and the engagement.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

With reference to FIGS. 1–6, the present invention in an embodiment provides a laser printer as will be described hereinafter.

Figure 1:
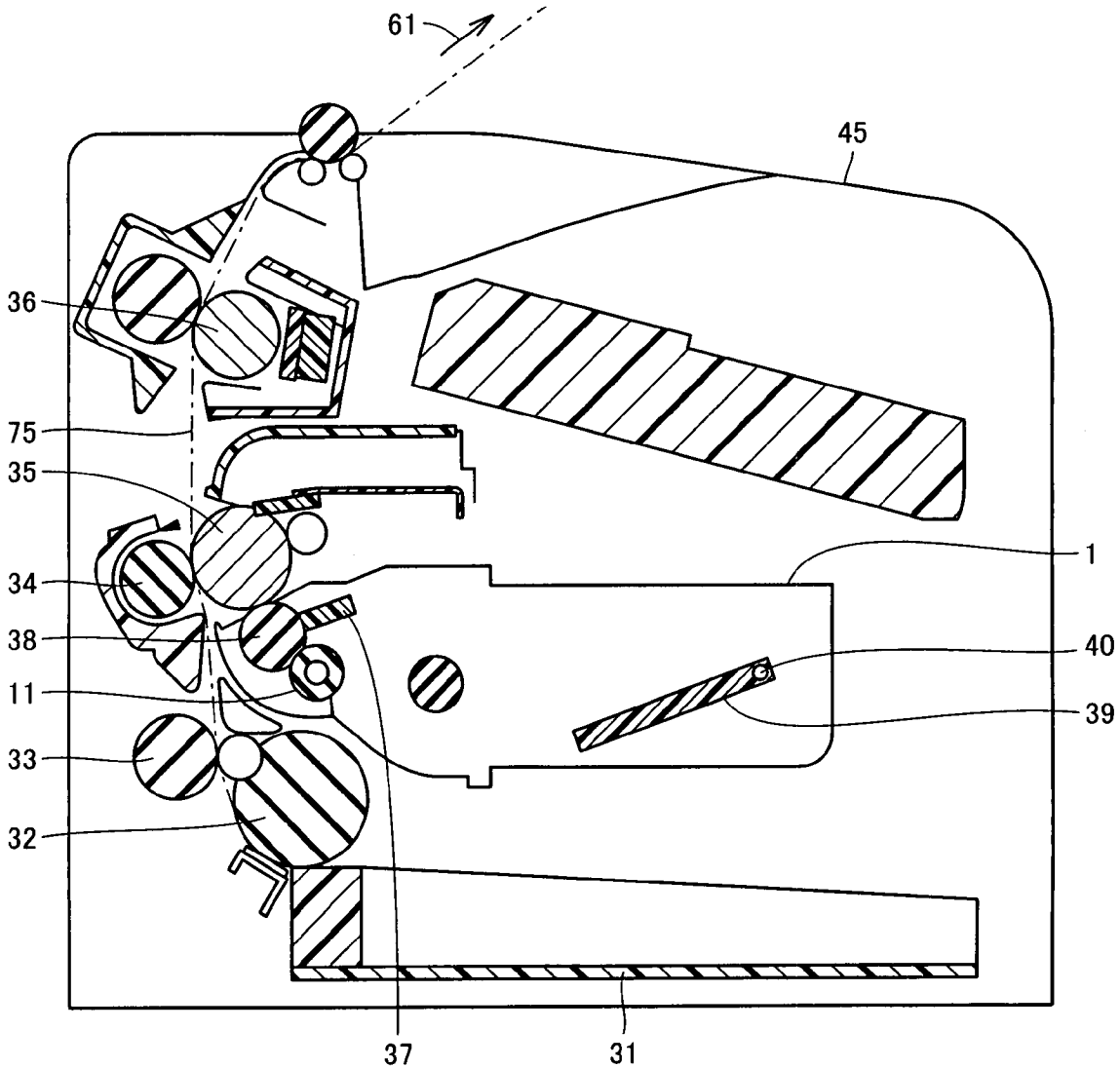
FIG. 1 is a schematic cross section of a laser printer.

FIG. 1 is a schematic cross section of the laser printer in the present embodiment. The laser printer has each component arranged in a casing 45. At a lower portion of casing 45 a sheet tray 31 is arranged to accommodate sheets or the like to be printed. (In the present invention, papers, cellophane sheets or the like to be printed will generally be referred to as sheets.) At an upper end of sheet tray 31 is arranged a pick roller 32 to extract a sheet from sheet tray 31. The sheet is transported along a transport path 75 in a direction 61.

Along transport path 75 are arranged a transport roller 33 transporting the sheet, and a photoreceptor drum 35 and a transfer roller 34 for placing toner on a surface of the sheet in a desired form. Also arranged along transport path 75 is a fixture roller 36 fixing the toner on the surface of the sheet.

Casing 45 accommodates substantially at a center thereof a toner cartridge 1 having toner introduced therein. Toner cartridge 1 internally has the toner therein. Toner cartridge 1 is exchangeably formed so that when the toner runs out, toner cartridge 1 having toner therein can be exchanged. In the present embodiment toner cartridge 1 is formed in a cuboid.

In FIG. 1 the right hand of the sheet of the figure corresponds to a front side of the printer and toner cartridge 1 is adapted to be extracted at the front side of the printer. The laser printer is adapted to discharge toward the front side the sheet or the like to be printed.

Toner cartridge 1 has an agitator plate 39 therein to agitate the toner accommodated therein. In the present embodiment, agitator plate 39 is formed in a flat plate. Agitator plate 39 is formed to have a main surface substantially in a rectangle and has one end supported by a supporter axis 40 so that agitator plate 39 can pivot to agitate the toner.

Internal to toner cartridge 1 at a portion facing photoreceptor drum 35 a developer roll 38 is arranged to place the toner on photoreceptor drum 35. Developer roll 38 is formed in a column to have a length, as seen widthwise, to correspond to that of photoreceptor drum 35. Developer roll 38 is arranged to linearly contract photoreceptor drum 35. At a side of developer roll 38 a blade 37 is arranged to have one end facing a surface of developer roll 38. Blade 37 can remove excessive toner placed on a surface of developer roll 38.

Figure 7:
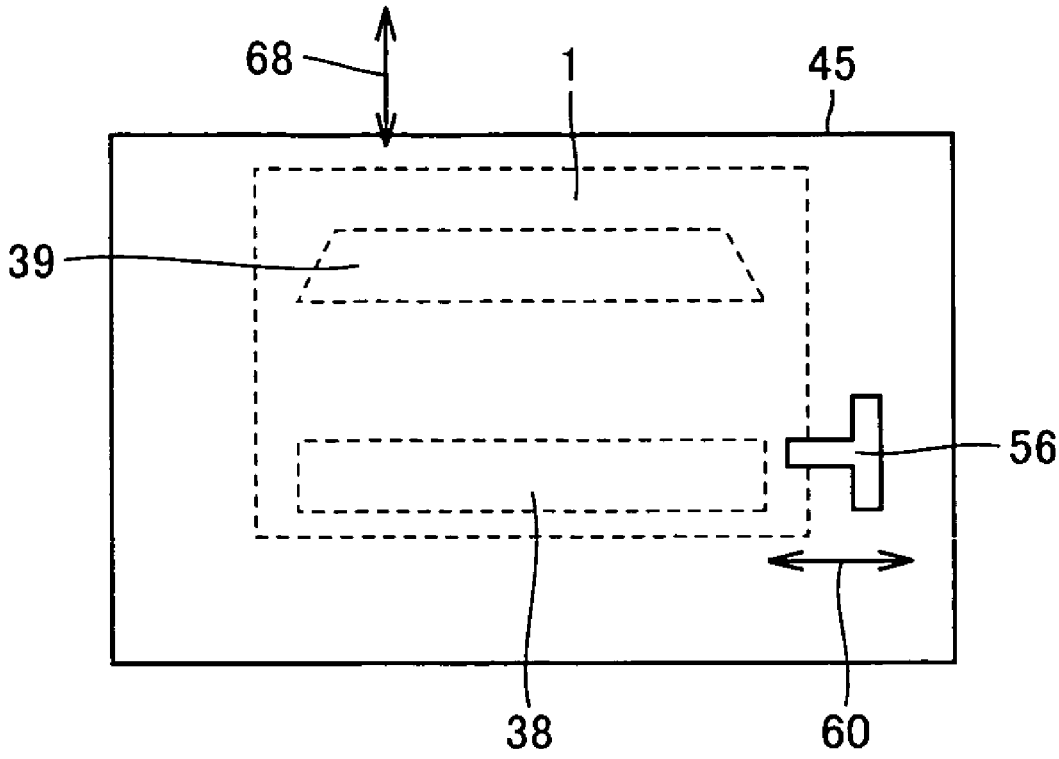
FIG.7 PRIOR ART
FIG. 7 is a schematic cross section for illustrating a portion transmitting driving force from the laser printer's main body to a toner cartridge.
Figure 8:
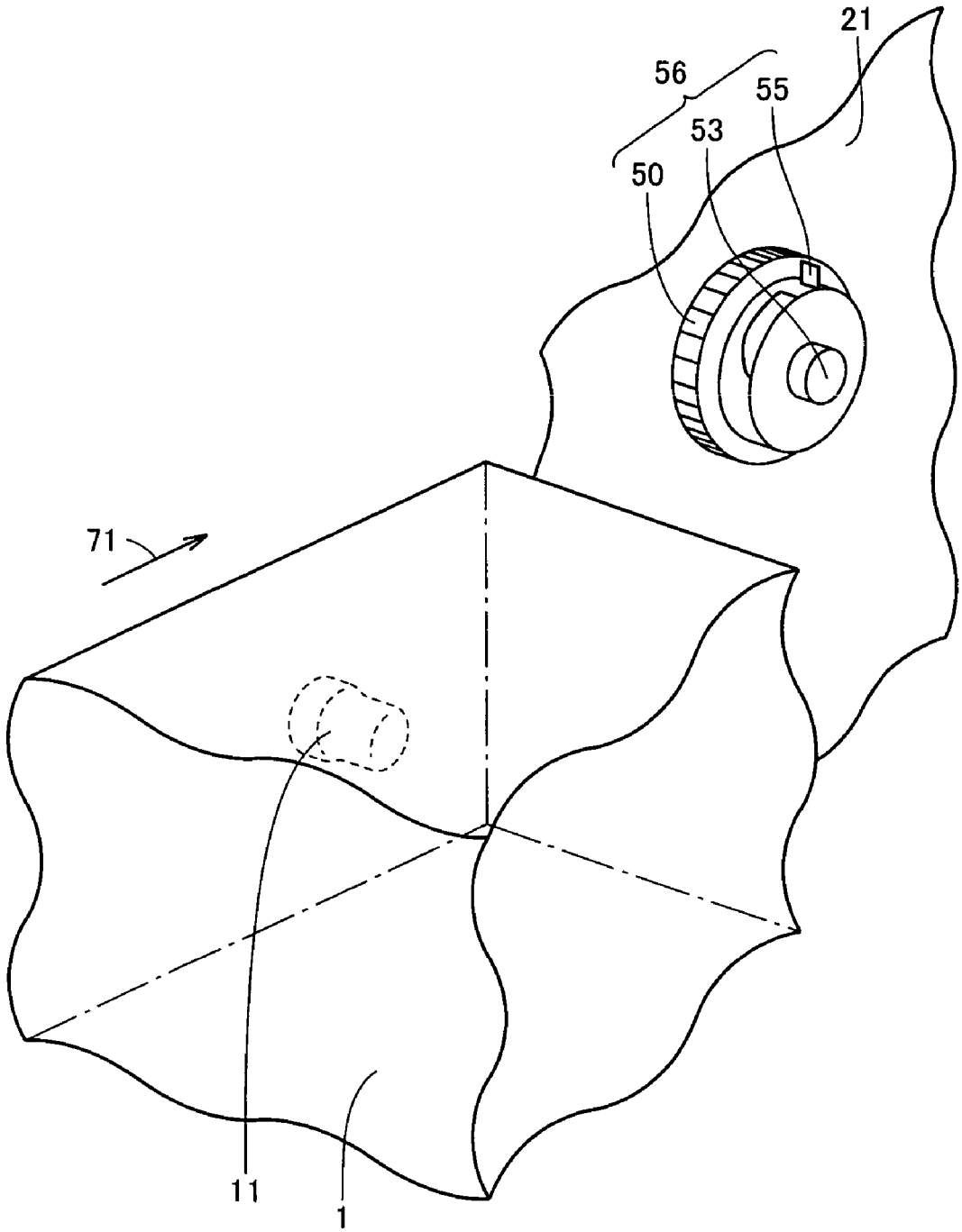
FIG.8 PRIOR ART
FIG. 8 is an enlarged perspective view of a portion corresponding to a coupling for transmitting driving force to a toner cartridge, as based on conventional art.
Figure 9:
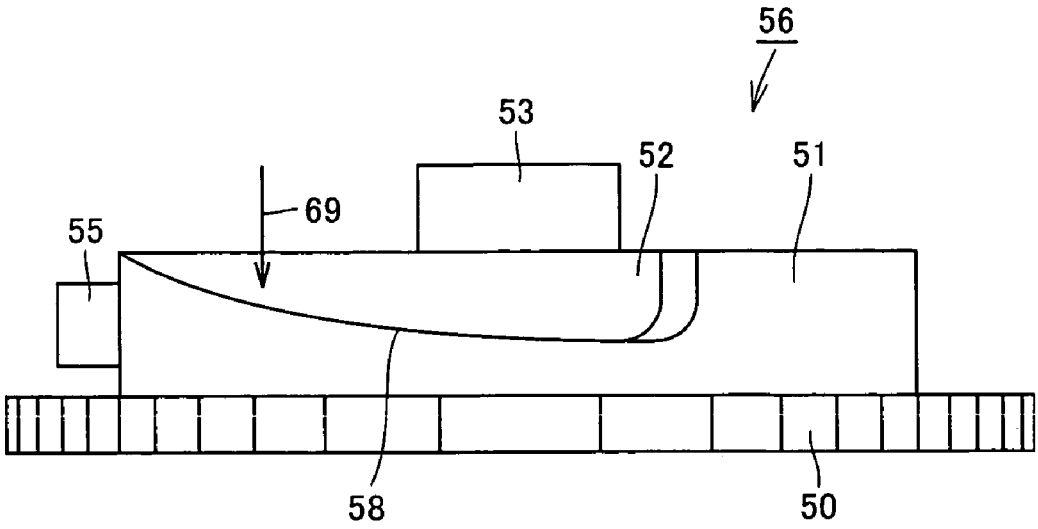
FIG.9 PRIOR ART
FIGS. 9 and 10 are first and second side views, respectively, of a coupling based on conventional art.
Figure 10:
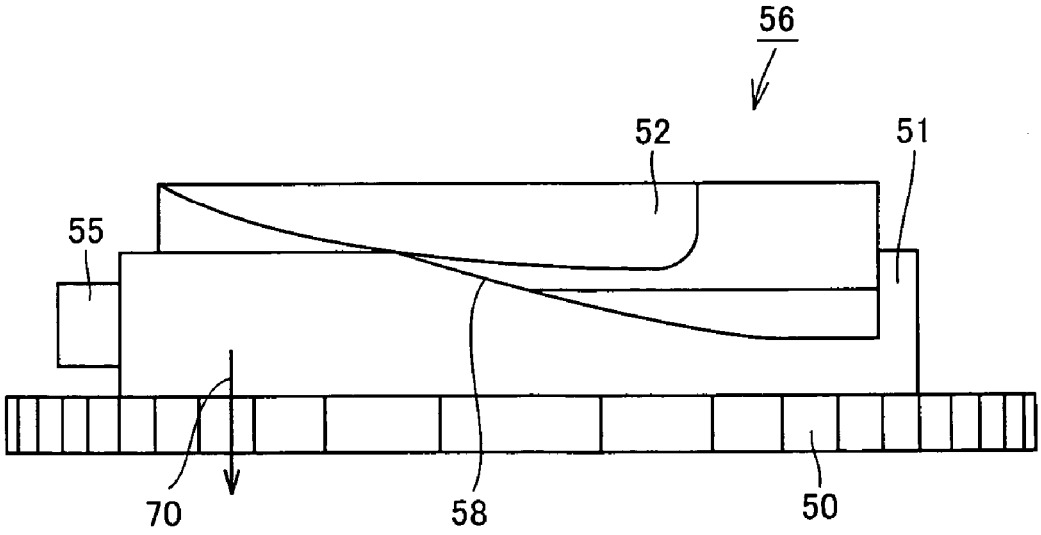
FIG.10 PRIOR ART

Toner cartridge 1 has a side surface provided with coupling insertion hole 11 for receiving force driving agitator plate 39 or the like. The laser printer's main body provides the force, which is transmitted through the coupling insertion hole to agitator plate 39 internal to toner cartridge 1. The force from the laser printer's main body for actuation is transmitted via the coupling to the toner cartridge, similarly as has been described for the prior art laser printer (see FIG. 7).

Figure 2:
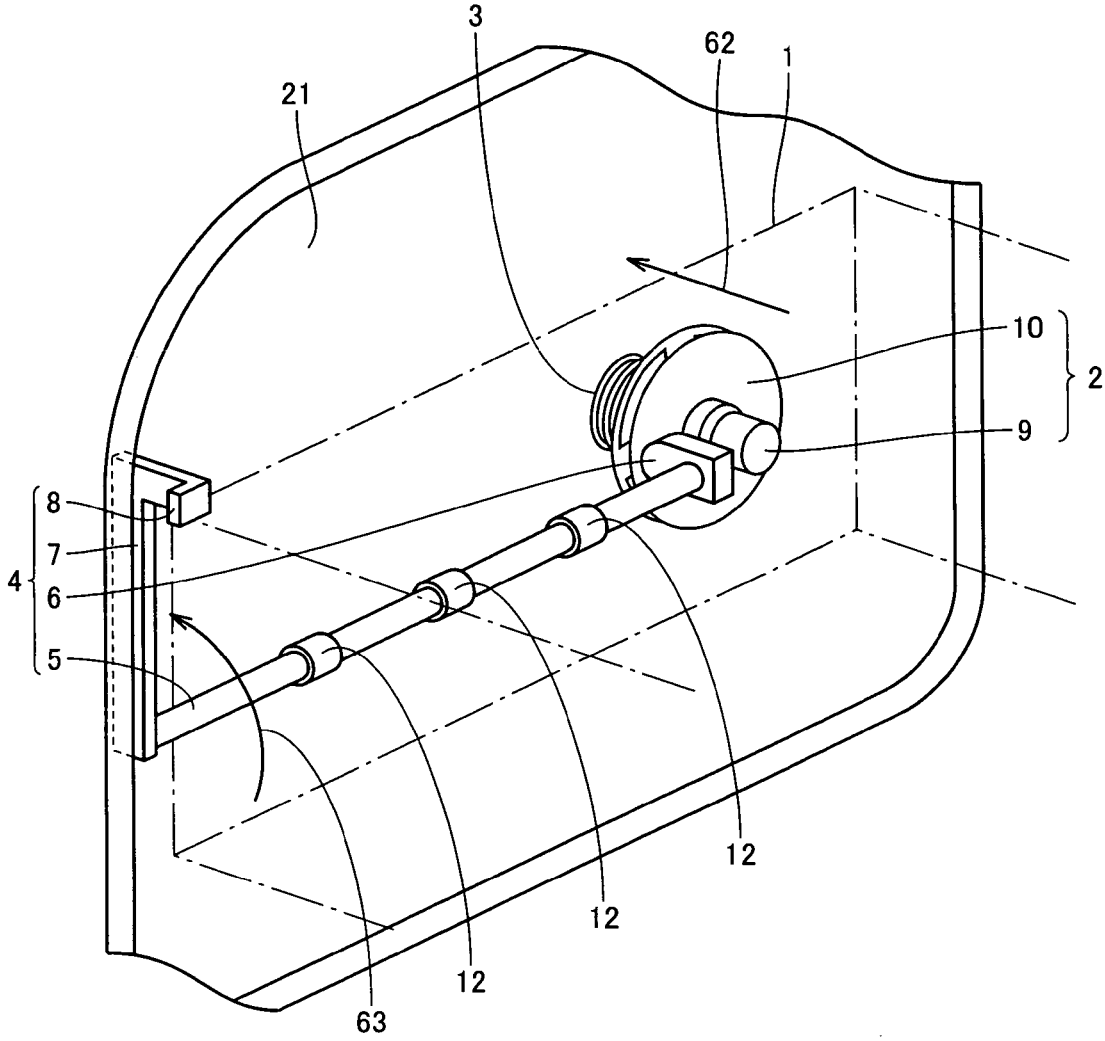
FIGS. 2 and 3 are first and second enlarged perspective views of a portion corresponding to a coupling in an embodiment.

FIG. 2 is a first enlarged perspective view of a portion corresponding to the coupling transmitting force to the toner cartridge for actuation. The laser printer includes a support frame 21 arranged at a side of toner cartridge 1, and a coupling 2 supported by support frame 21. In the present embodiment, support frame 21 is formed in a flat plate and arranged to have a main surface substantially parallel to the laser printer's forward and backward directions and upward and downward directions.

Coupling 2 is formed to be movable toward toner cartridge 1 as well as away therefrom. Coupling 2 is adapted to be biased toward the toner cartridge by biasing means implemented by a spring 3. More specifically, spring 3 is so formed that when coupling 2 does not have force exerted thereto coupling 2 moves toward toner cartridge 1. Spring 3 is fixed to support frame 21. Spring 3 does not rotate together with coupling 2 as coupling 2 rotates.

The printer's main body is provided with coupling drive means (not shown). Coupling 2 has the coupling drive means (not shown) connected thereto and thus rotates. Coupling 2 is rotated by the coupling drive means around an axis of rotation parallel to a direction toward the toner cartridge.

Coupling 2 includes a disk 10 and an insert 9 formed to protrude from disk 10. Disk 10 is formed to be able to transmit the coupling drive means' rotational movement to insert 9 if insert 9 and the coupling drive means have their respective axes of rotation substantially on a single straight line. Insert 9 is in the form of a column at a side facing the toner cartridge. Insert 9 is inserted into the toner cartridge's coupling insertion hole (see FIG. 1) to engage with a linking portion formed internal to the coupling insertion hole.

The laser printer includes a coupling receding arm 4 moving coupling 2 toward and/or away from the toner cartridge. In other words, coupling receding arm 4 is provided as a coupling receding means for determining a position of coupling 2 in a direction parallel to that toward the toner cartridge. Coupling receding arm 4 is formed of a single member.

Coupling receding arm 4 includes an arm portion 5 in the form of a rod formed to have an axis extending in the laser printer's forward and backward directions. Coupling receding arm 4 includes an engagement 6 at an end of arm portion 5 that is closer to coupling 2 (or the printer's rear side).

Figure 5:
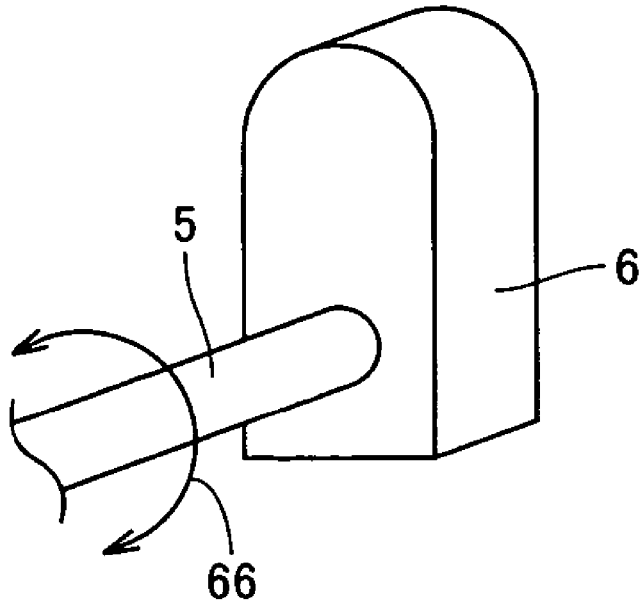
FIG. 5 is an enlarged perspective view of an engagement in the embodiment.

FIG. 5 is an enlarged perspective view of engagement 6. Engagement 6 is formed substantially in a cuboid and connected to arm portion 5 at a position other than a midpoint of the cuboid as seen lengthwise. Engagement 6 has a main surface perpendicular to the arm portion 5 longitudinal axis. Engagement 6 in the form of the cuboid has one end, as seen lengthwise, in the form of a semi-circle as seen in cross section. In other words, engagement 6 is a cuboid having one end with a corner rounded off.

In FIG. 2, coupling receding arm 4 has arm portions 5 supported by an arm guide 12 fixed to support frame 21 by fixture means (not shown). A plurality of arm guides 12 are provided adapted to allow arm portion 5 to be rotatable.

Arm portion 5 at an end distant from the coupling (or closer to the printer's front side) is provided with a lock lever 7 in a flat plate in the form of the letter L as seen in a plane. Lock lever 7 in the form of the letter L has one end connected to arm portion 5 and the other end provided with a protrusion 8 protruding a surface thereof toward the laser printer's front side. In the present embodiment, lock lever 7 is formed to conform to a front geometry of toner cartridge 1. More specifically, it is formed in the letter L, as seen in a plane, to conform to a rectangular contour corresponding to a front geometry of toner cartridge 1.

Coupling receding arm 4 is rotatable around the arm portion 5 longitudinal axis. More specifically, coupling receding arm 4 has an axis of rotation in a direction parallel to the arm portion's longitudinal direction. In FIG. 2, it is formed to raise lock lever 7 in a direction 63.

Figure 3:
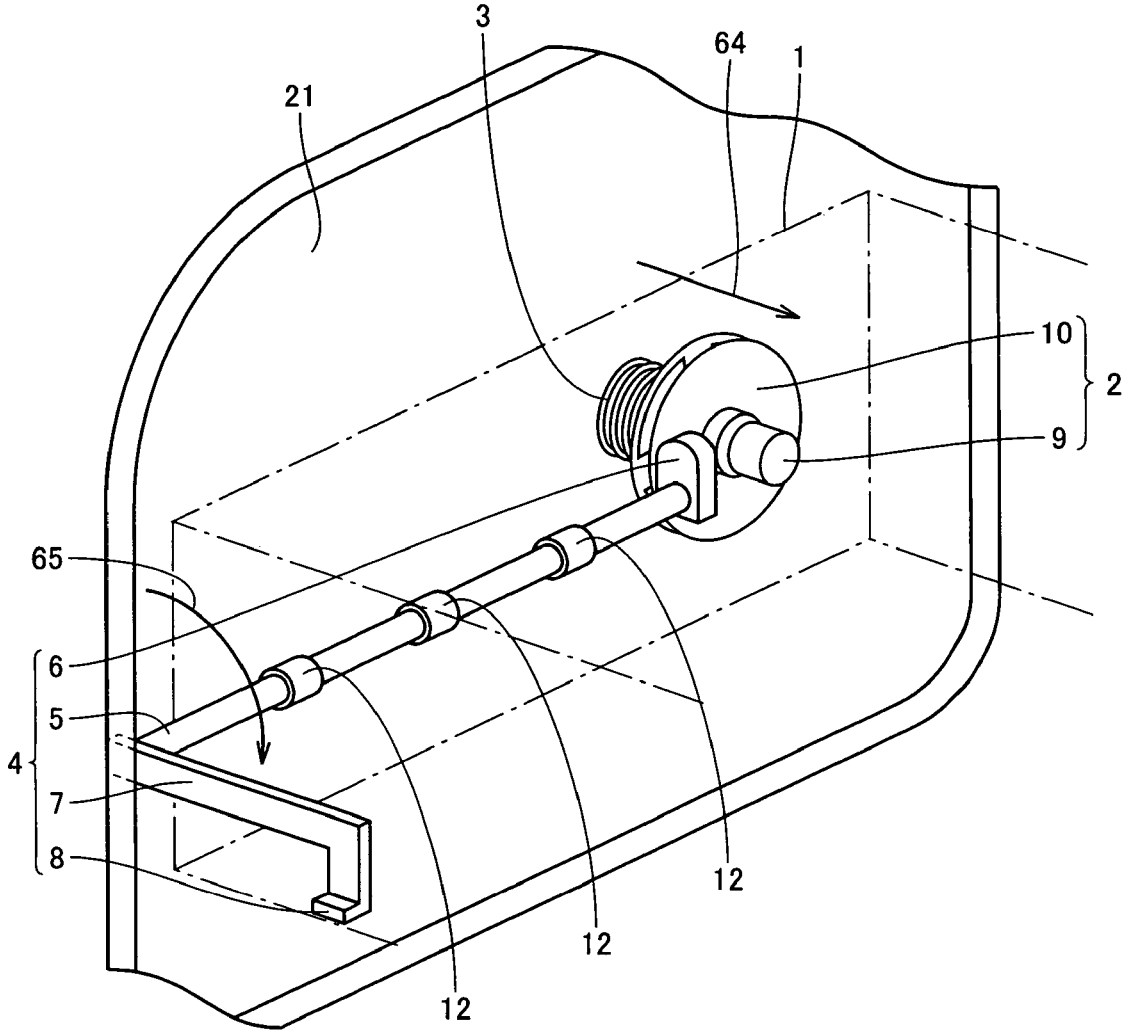

FIG. 3 is a second enlarged perspective view of the portion corresponding to the coupling transmitting the toner cartridge's internal force for actuation. Coupling receding arm 4 can rotate around the arm portion 5 longitudinal axis, as indicated by an arrow 65, to turn lock lever 7 downward.

Lock lever 7 is so adapted that when it is raised in direction 63, as shown in FIG. 2, toner cartridge 1 can be ejected from the front side. Furthermore, lock lever 7 is so adapted that when it is turned in direction 65, as shown in FIG. 3, it can secure a front side of toner cartridge 1 to prevent the cartridge from popping out.

As shown in FIG. 2, coupling receding arm 4 is so adapted that when lock lever 7 is raised to have its longitudinal direction substantially vertically, engagement 6 has its longitudinal direction substantially parallel to a direction in which coupling 2 faces toner cartridge 1. More specifically, it is so arranged that the engagement 6 longitudinal direction and the coupling's contact surface are substantially perpendicular. Furthermore, as shown in FIG. 3, coupling receding arm 4 is so adapted that when lock lever 7 is turned downward to have its longitudinal direction substantially horizontally, engagement 6 has its longitudinal direction substantially perpendicular to the direction in which coupling 2 faces toner cartridge 1. More specifically, it is so arranged that the engagement 6 longitudinal direction and the coupling's contact surface are substantially parallel.

Lock lever 7 has protrusion 8 protruding toward the laser printer's front side. Protrusion 8 does not interfere with support frame 21 and toner cartridge 1 as the lock lever is moved.

In FIG. 1 a sheet or the like to be printed is arranged in sheet tray 31. The sheet is transported along transport path 75. The sheet is extracted by pick roller 32 from sheet tray 31, one at a time, and transported by transport roller 33 to photoreceptor drum 35.

Internal to toner cartridge 1, developer roll 38 is rotated to supply photoreceptor drum 35 with toner accommodated in toner cartridge 1. As it is transported through between photoreceptor drum 35 and transfer roller 34, the sheet is provided on a surface thereof with toner in a shape to be printed.

The sheet having passed between transfer roller 34 and photoreceptor drum 35 is transported toward fixture roller 36. The sheet with toner placed thereon contacts fixture roller 36 and thus has the toner fixed thereon. Thereafter, the sheet is transported for example by a transport roller to an output port. The sheet or the like to be printed is thus printed.

As shown in FIG. 2, to remove toner cartridge 1 from the laser printer's main body, lock lever 7 is rotated around the arm portion 5 longitudinal axis and thus raised as indicated by arrow 63. Lock lever 7 is detached from a front side of toner cartridge 1. Lock lever 7 can be readily pulled up by hooking protrusion 8 for example with a finger.

In the present embodiment, raising lock lever 7 rotates arm portion 5 and thus rotates substantially by 90° engagement 6 arranged at the rear end of arm portion 5 (see FIG. 5, an arrow 66). Engagement 6 rotates around the arm portion 5 longitudinal axis. Engagement 6 thus has its longitudinal direction substantially perpendicular to a surface of disk 10 of coupling 2. Engagement 6 thus rotated pushes the surface of disk 10 of coupling 2.

Coupling 2 thus pushed by engagement 6 moves in a direction 62. As coupling 2 moves, coupling 2 has insert 9 receding from coupling insertion hole 11 of toner cartridge 1 (see FIG. 1). After coupling 2 recedes from toner cartridge 1, toner cartridge 1 can be removed from the coupling receding arm's side provided with the lock lever (in the present embodiment, the front side of the laser printer's main body) or toner cartridge 1 can be inserted toward the laser printer's main body from the coupling receding arm's side provided with the lock lever.

As shown in FIG. 3, when toner cartridge 1 is inserted into the laser printer's main body, lock lever 7 is rotated around the arm portion 5 longitudinal axis and thus turned downward as indicated by arrow 65. In the present embodiment coupling receding arm 4 has lock lever 7 rotated by 90°, as indicated by arrow 65, and thus turned downward. Lock lever 7 can be readily turned downward by hooking protrusion 8 for example with a finger.

Figure 4:
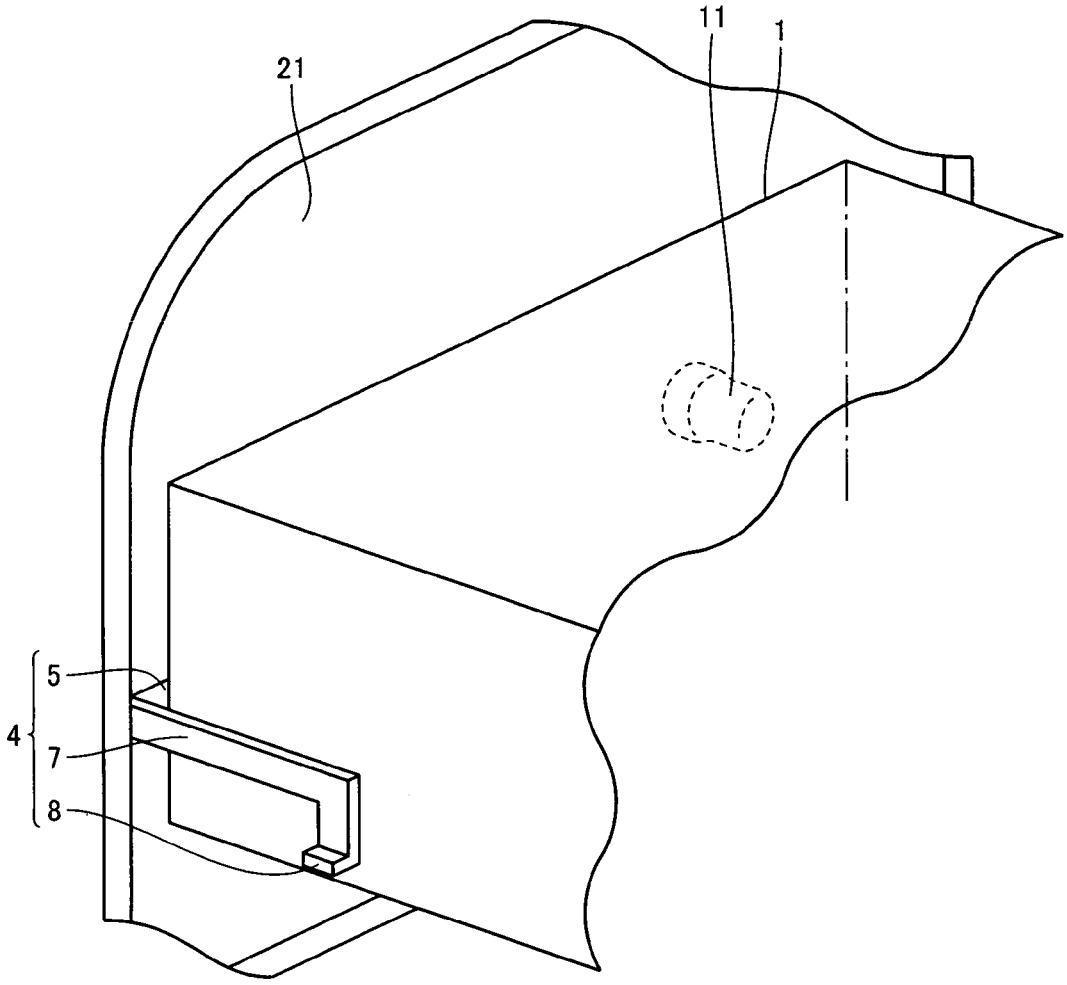
FIG. 4 is an enlarged perspective view in the embodiment with a coupling receding arm's lock lever turned downward.

FIG. 4 is a perspective view with lock lever 7 turned downward. Lock lever 7 turned downward contacts a surface of toner cartridge 1 (in the present embodiment, a front surface thereof). Lock lever 7 contacting the front surface of toner cartridge 1 can secure toner cartridge 1 immovably.

As shown in FIG. 3, turning lock lever 7 downward allows engagement 6 to have its longitudinal direction substantially parallel to a surface of disk 10 of coupling 2. Coupling 2 is forced by spring 3 biased to move in a direction 64. The coupling 2 insert 9 is inserted into the toner cartridge 1 coupling insertion hole 11 (see FIGS. 1 and 4). By inserting insert 9 into the coupling insertion hole, the coupling 2 insert is mechanically linked to a linking portion of a drive formed internal to toner cartridge 1.

When the laser printer is being driven, coupling 2 rotates to transmit driving force into toner cartridge 1 to drive the agitator plate and the like provided in toner cartridge 1.

Thus in the present embodiment the coupling receding means implemented by a coupling receding arm is formed of a single member and includes an arm portion in the form of a rod, an engagement moving the coupling, and a lock lever securing and releasing a toner cartridge. Such arrangement can provide a laser printer having a simple configuration and formed a reduced number of components.

Furthermore, the lock lever is provided at one end of the arm portion and has a geometry conforming to a surface of the toner cartridge. Thus when the lock lever is raised it does not prevent the toner cartridge from being removed. Furthermore, the lock lever turned downward can secure the toner cartridge. Furthermore, the lock lever can be small in size, which can contribute to increased productivity and also reduce the laser printer in size.

In the present embodiment the lock lever is formed in the letter L as seen in a plane. However, it is not limited to this manner and may have any geometry. For example, it may be arcuate as seen in a plane.

In the present embodiment the lock lever has an end including a protrusion protruding from a main surface of the lock lever. This allows the lock lever to be hooked for example with a finger and thus readily turned downward/raised.

In the present embodiment the engagement is provided at an end of the arm portion of the coupling receding arm, and furthermore has a longitudinal direction and has the arm portion connected thereto at a position other than a midpoint of the engagement as seen in that longitudinal direction. Such arrangement can facilitate forming the engagement easily.

In the present embodiment, as indicated in FIG. 5 by arrow 66, arm portion 5 can be rotated to rotate engagement 6 so as to move coupling 2. In particular, in the present embodiment, engagement 6 is formed in a cuboid having one end curved as seen in cross section. Thus when the coupling receding arm is moved the engagement can contact the coupling less frictionally or more smoothly so as to readily move the coupling receding arm.

Figure 6:
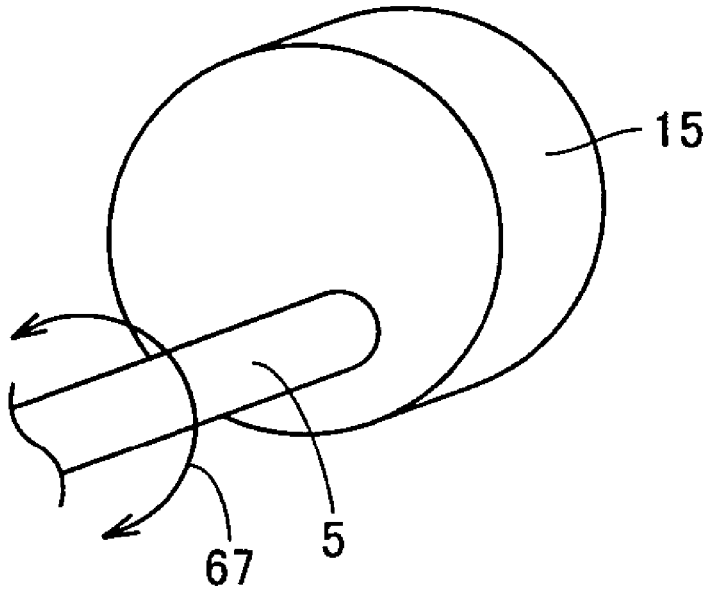
FIG. 6 is an enlarged perspective view of another engagement in the embodiment.

In the present embodiment the engagement has a longitudinal direction. However, it is not limited to this manner, and for example, as shown in FIG. 6, may be formed in a circle as seen in a plane. In FIG. 6, an engagement 15 is formed in a column having one end surface with arm portion 5 connected thereto at a position other than the circle's center. Furthermore, engagement 15 is perpendicular at a surface thereof to the axis of arm portion 5. By rotating arm portion 5 in a direction 67, the coupling can be moved. Thus the engagement may not have a longitudinal direction. In other words, the engagement may have any form that allows the coupling to be moved when the arm portion is rotated around its axis.

Furthermore in the present embodiment the coupling receding arm includes a lock lever formed in the letter L, as seen in a plane, having one end with the arm portion fixed thereto and the other end provided with a protrusion. Furthermore, the engagement is formed in a cuboid having one surface with the arm portion fixed thereto. This arrangement facilitates providing the coupling receding arm with the engagement and the lock lever.

Furthermore in the present embodiment the coupling receding arm includes a lock lever arranged at a front side of a laser printer. However, it is not limited to this manner and may be arranged in any manner that allows it to contact one surface of the toner cartridge. For example, if the toner cartridge is adapted to be attached/detached through an upper side of the laser printer, the coupling receding arm may have the lock lever arranged at the upper side of the laser printer to press an upper surface of the toner cartridge.

The present invention can thus provide a laser printer having a simple configuration and formed of a reduced number of components.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A laser printer comprising:

a front side, wherein a toner cartridge is removable from the laser printer through the front side;

a support frame arranged at a side of said toner cartridge;

a coupling supported by said support frame, movable toward and away from said toner cartridge, and including an insert at a side thereof facing said toner cartridge;

a spring biasing to force said coupling toward said toner cartridge;

a coupling receding arm moving said coupling, said coupling receding arm being formed of a single member and including:

an arm portion formed of a rod having an axis extending in forward and backward directions, an engagement provided at a rear end of said arm portion in a cuboid and connected to said arm portion at a portion of said cuboid other than a midpoint of said cuboid as seen lengthwise, and a lock lever provided at a front end of said arm portion in a flat plate in a form of a letter L, as seen in a plane, and connected at one end of said L letter to said arm portion, wherein said coupling receding arm is adapted such that when said toner cartridge is attached, said lock lever is rotated around said arm portion's longitudinal axis and thus turned downward to contact a front surface of said toner cartridge and said engagement is set to have a longitudinal direction substantially parallel to said coupling's contact surface to allow said insert to be inserted into said toner cartridge, and wherein to remove said toner cartridge, said lock lever is rotated around said arm portion's longitudinal axis and thus raised to detach from said toner cartridge and said engagement is set to have its longitudinal direction substantially perpendicular to said coupling's contact surface to push said coupling to recede said insert from said toner cartridge.

2. A laser printer comprising:

a coupling movable in a direction parallel to that toward a toner cartridge, and including an insert for transmitting driving force to said toner cartridge;

biasing means for biasing said coupling toward said toner cartridge; and coupling receding means for determining a position of said coupling in said direction parallel, said coupling receding means being formed of a single member and including:

an arm portion formed of a rod, an engagement connected to a first end of said arm portion and rotated around said arm portion's longitudinal axis to move said coupling in said direction parallel, and a lock lever connected to a second end of said arm portion and rotated around said arm portion's longitudinal axis to lock and unlock said toner cartridge, said coupling receding means moving said lock lever in one direction to insert said insert into said toner cartridge and cause said lock lever to contact one surface of said toner cartridge.

3. The laser printer according to claim 2, wherein said lock lever is flat to conform to a geometry of a surface securing said toner cartridge and has an end having a protrusion protruding from a main surface thereof.

4. The laser printer according to claim 2, wherein said engagement has a longitudinal direction and has said arm portion connected thereto at a location other than a midpoint as seen in said longitudinal direction of said engagement.

5. The laser printer of claim 2, wherein:

said lock lever is formed in a letter L, as seen in a plane, having one end with said arm portion fixed thereto and the other end provided with a protrusion; and said engagement is formed in a cuboid having one surface with said arm portion fixed thereto.

* * * * *